United States Patent [19]

Focke et al.

[11] 4,382,575

[45] May 10, 1983

[54] WEDGE SHAPED CHUTE WALLS WITH BENT ENDS FOR CIGARETTE MAGAZINES

[75] Inventors: Heinz Focke, Verden; Bernhard Focke, Bremen, both of Fed. Rep. of Germany

[73] Assignee: Focke & Co., Verden, Fed. Rep. of Germany

[21] Appl. No.: 238,278

[22] Filed: Feb. 25, 1981

Related U.S. Application Data

[62] Division of Ser. No. 23,916, Mar. 26, 1979, Pat. No. 4,279,955.

[30] Foreign Application Priority Data

Apr. 1, 1978 [DE] Fed. Rep. of Germany ..... 2814166

[51] Int. Cl.[3] ..... B22D 5/00

[52] U.S. Cl. ..... 249/93; 249/83; 249/91; 269/8; 269/305

[58] Field of Search ..... 269/8, 303, 305, 289 R, 269/246, 203; 249/83, 91, 93, 120, 129, 159, 167

[56] References Cited

U.S. PATENT DOCUMENTS

| | | | |
|---|---|---|---|
| 1,580,281 | 4/1926 | Bowe | 249/93 |
| 1,760,282 | 5/1930 | Pedersen | 249/93 |
| 2,487,944 | 11/1949 | Pressman | 269/8 |
| 3,321,201 | 5/1967 | Brewster | 269/305 X |
| 3,819,145 | 6/1974 | Huber et al. | 249/93 X |

*Primary Examiner*—Leon Gilden

*Attorney, Agent, or Firm*—Sughrue, Mion, Zinn, Macpeak and Seas

[57] ABSTRACT

A cigarette magazine chute wall is formed by two metal sheets 11, 12 glued together in an arc-shaped zone **10*b* and filled with a moldable spacer material 14 in a wedge-shaped zone 10*a*. Grooved pins 15, 16 and threaded bushes 17, 18 are embedded in the filler to implement the anchoring of the sheets and their subsequent assembly in a magazine. A mold assembly is built up by clamping together a plurality of curved mold plates 20, and disposing a pair of magnetically fixed sheets 11, 12 between adjacent plates, whereafter the filler 14** is introduced under pressure.

7 Claims, 7 Drawing Figures

WEDGE SHAPED CHUTE WALLS WITH BENT ENDS FOR CIGARETTE MAGAZINES

This is a division of application Ser. No. 23,916, filed Mar. 26, 1979 now U.S. Pat. No. 4,279,955.

BACKGROUND OF THE INVENTION

This invention relates to a partition for forming chambers within a container, in particular to a chute wall for cigarette magazines. The invention further relates to a method and apparatus for the manufacture of the partitions or chute walls.

In the packaging of cigarettes, magazines for collecting, arranging and forming groups are generally known and customary. These special containers are provided in their lower zone with chutes by means of a plurality of chute walls arranged at intervals. Each magazine chute receives a series of cigarettes arranged one above the other. At the lower end of these chutes the cigarettes are expelled in groups from the magazine.

The chute walls of the cigarette magazine must be very precisely finished. In shaping them, it is necessary to ensure that the downward flux of cigarettes under their own weight should take place easily. Furthermore, the cigarettes must not be subjected to excessive mechanical stresses during this exit movement. The manufacture of such chute walls, which have hitherto consisted exclusively of metal, is therefore relatively involved and expensive.

SUMMARY OF THE INVENTION

It is the object of this invention to facilitate and simplify the manufacture of chute walls for cigarette magazines by means of a novel constructional design, and to do so where the chute walls have a difficult shape.

To achieve this object the partitions according to the invention are characterized by two outer metal sheets bonded to one another, between which, at least in a limited zone, is located a spacer. The spacer consists of an originally moldable composition which is introduced into the zone between the metal sheets and is there hardened to give a precise spacer.

By using external, easily moldable metal sheets, and an originally moldable composition located between them, relatively complex, wedge-shaped and/or arc-shaped partitions can be manufactured without expensive machining or other finishing. The appropriately cut metal sheets are brought into the relative position corresponding to the shape of the partitions. In the case of wedge-shaped partitions this forms a corresponding interspace, which is filled with a moldable, hardening composition.

DETAILED DESCRIPTION OF THE PREFERRED EMBODIMENT

Figure 1:
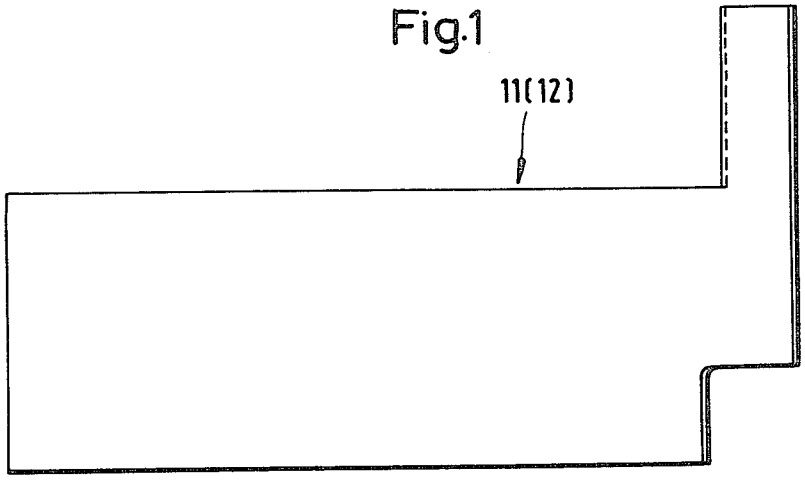
FIG. 1 shows a metal sheet as the outer layer for a chute wall of a cigarette magazine, in plan view.
Figure 2:
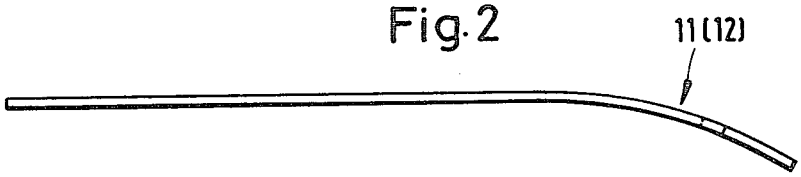
FIG. 2 shows the metal sheet according to FIG. 1, in side view.
Figure 3:
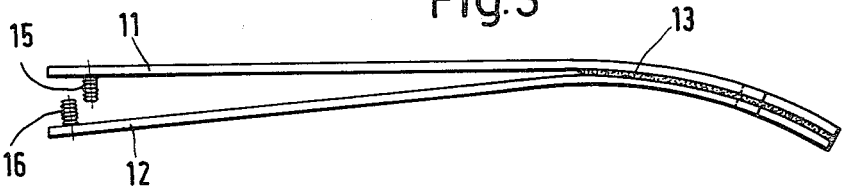
FIG. 3 shows two metal sheets in the sense of FIGS. 1 and 2, in a relative position appropriate for forming a chute wall, and bonded to one another in a limited zone.
Figure 4:
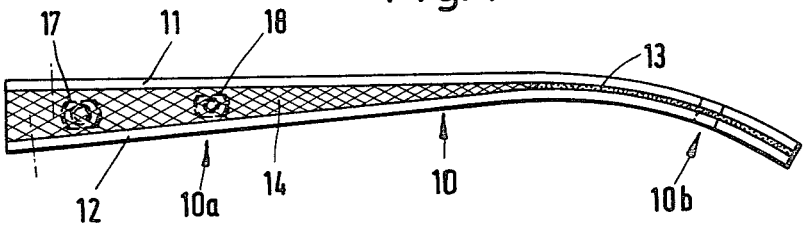
FIG. 4 shows a chute wall for cigarette magazines, in side view.

The embodiment shown relates to chute walls 10 for cigarette magazines in which an upper zone 10*a* is of wedge-shaped construction and a lower outlet zone for the cigarettes is of arc-shaped construction (FIG. 4).

Each chute wall consists of two outer metal sheets 11 and 12 which are bonded to one another by an adhesive 13 applied as a continuous layer in a limited zone, namely in the arc-shaped zone 10*b*. Outside this zone, namely in the entire zone 10*a* of the divergent or wedge-like shape of the chute wall 10, a correspondingly wedge-shaped spacer 14 is located between the metal sheets 11, 12. The metal sheets 11 and 12 rest against this spacer.

The spacer 14 is produced and molded between the metal sheets 11, 12, which are fixed in the corresponding relative position, during the manufacture of the chute wall 10. The spacer 14 consists of an originally moldable filler material which is introduced in the moldable state between the metal sheets 11, 12 which are arranged in the divergent position. The filler for forming the spacer 14 can for example consist of two components which are filled with about 80% of aluminum powder. The paste used for this filler is commercially available. After introducing this filler between the splayed metal sheets 11, 12 the filler hardens and as a result forms the wedge-shaped spacer.

In order to ensure an improved, durable bond between the metal sheets 11, 12 and the spacer 14, the former are provided on their inner faces with projections embedded in the filler constituting the spacer. In the embodiment shown these projections are grooved pins 15 and 16. These pins, respectively connected to the metal sheets 11 and 12, are provided with a plurality of transverse grooves which are positively embedded in the composition of the spacer 14.

In producing the spacer 14 from moldable, hardened filler, the constructional components required for the subsequent use of the chute walls 10 are at the same time embedded in the composition and hence in the spacer 14. In the present embodiment two threaded bushes 17 and 18 are anchored in the spacer 14 in the moldable state.

By means of the spacer 14 which is formly bonded to the metal sheets 11, 12, and by means of the adhesive 13, the outer shape of the chute wall 10 shown in FIG. 4, including the arc-shaped zone 10*b*, is permanently fixed.

Figure 5:
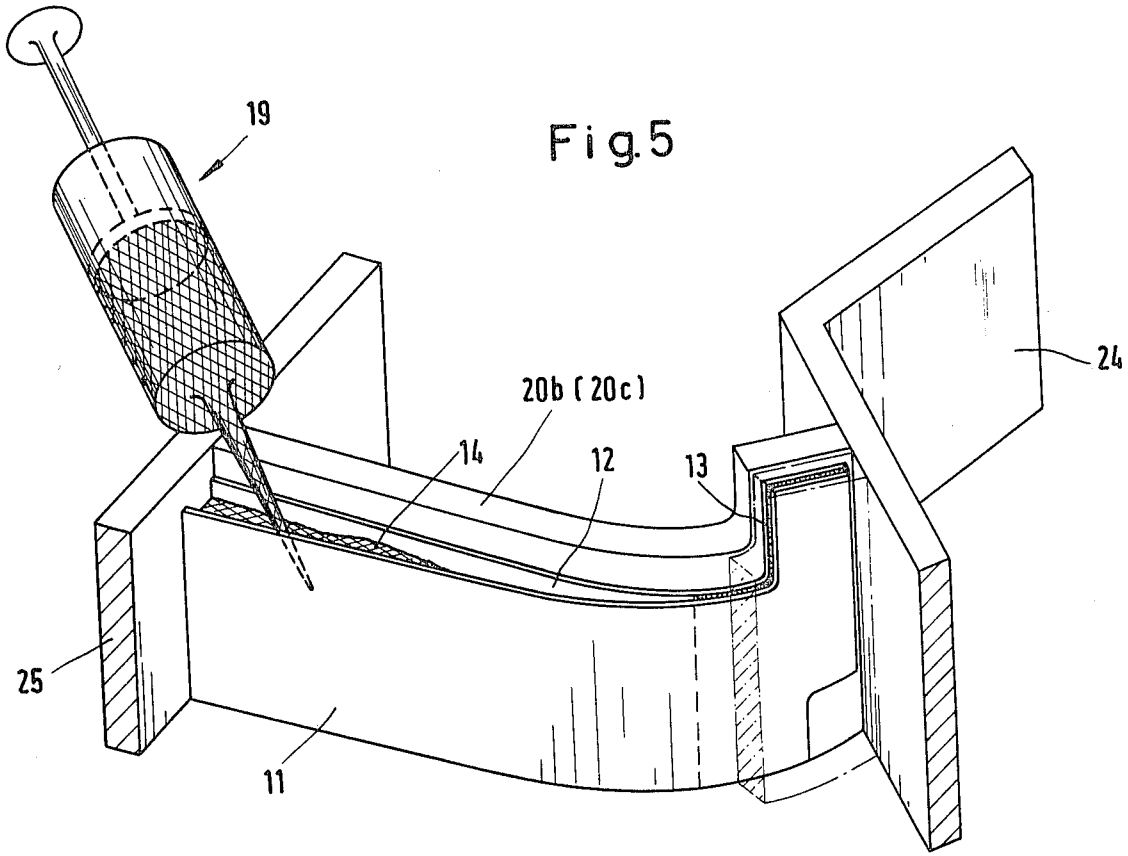
FIG. 5 shows a perspective view of a part of an apparatus for the manufacture of chute walls according to FIG. 4, during the introduction of the filler.
Figure 6:
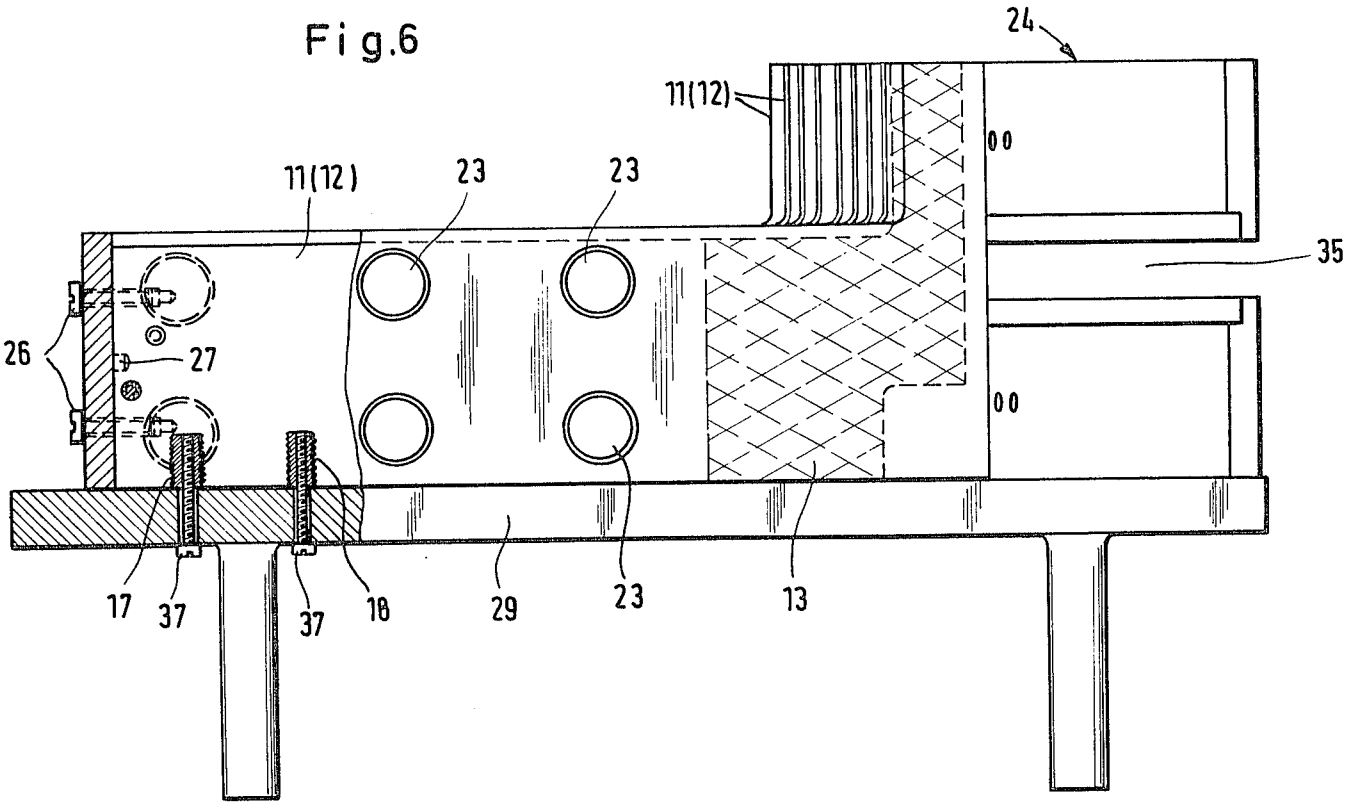
FIG. 6 shows a side view of the apparatus for the manufacture of magazine chutes, partly in vertical section

To manufacture the chute walls 10 the separately produced metal sheets 11, 12 are clamped in the required relative position and with the desired outer geometrical shape in an apparatus. In the latter, the metal sheets 11, 12 are next bonded to one another in the arc-shaped zone 10*b* by the adhesive 13. After the adhesive has set the moldable filler for forming the spacer 14 is introduced into the wedge-shaped zone 10*a*. Advantageously, this introduction is effected under pressure. FIG. 5 shows, schematically, an injection apparatus 19 by means of which the pourable filler is introduced between the metal sheets 11 and 12. This injection process substantially accelerates the introduction of the composition.

During this process, the metal sheets 11, 12 are each accommodated between two molding plates 20*a*, 20*b*, 20*c*. These molding plates 20*a*, 20*b* . . . correspond, in their shape and relative arrangement, to the other contours of the chute wall 10. Accordingly, adjacent molding plates 20*a*, 20*b* etc. are arranged convergently so that a chute wall 10 can be accommodated between two adjacent molding plates 20*a*, 20*b*.

Figure 7:
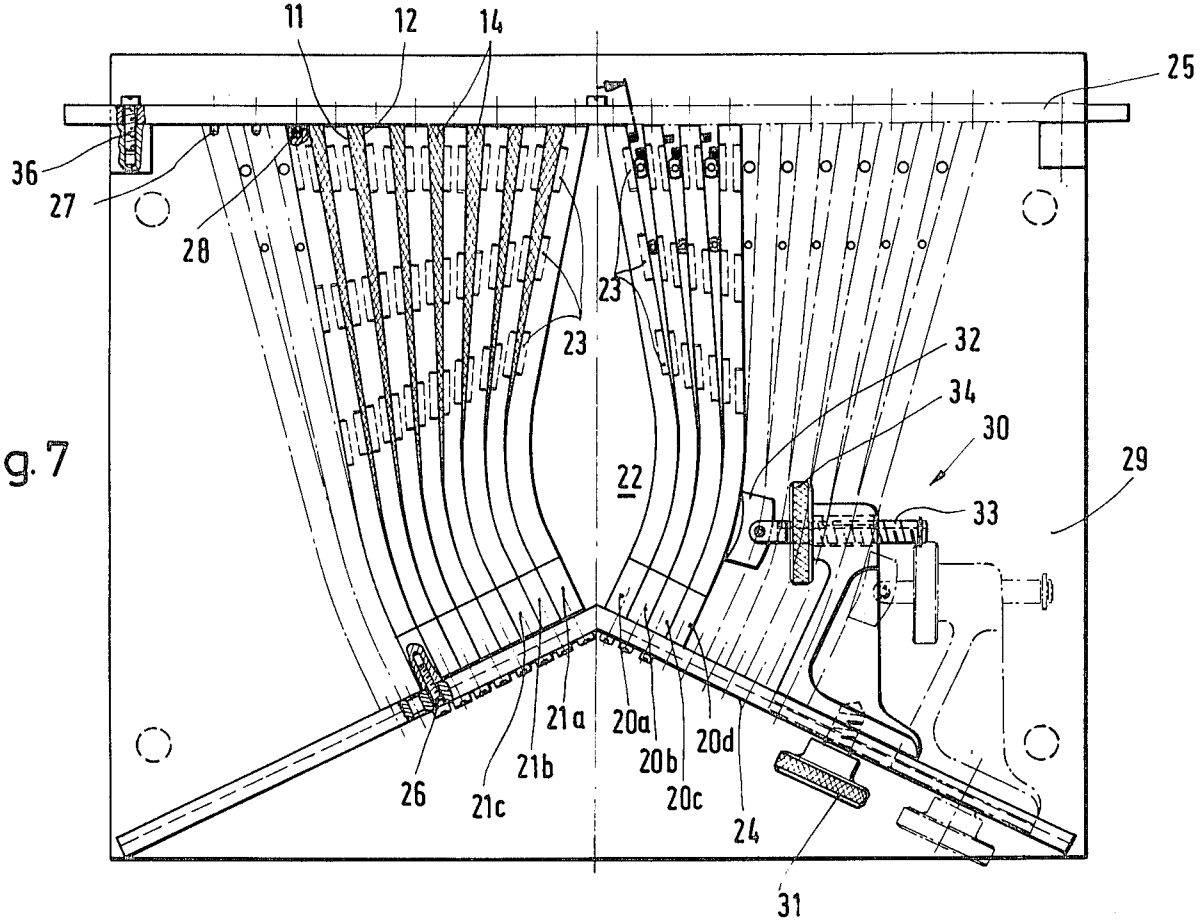
FIG. 7 shows the total apparatus, in plan view.

In a cigarette magazine the chute walls have different shapes and sizes. The outer chute walls of two groups of such walls are each longer and have a less pronounced arc. The two groups of such chute walls are arranged in a more or less mirror-image manner relative to a vertical middle plane. Correspondingly, the apparatus according to FIG. 7 is also provided with two groups of molding plates 20*a*, 20*b*, 20*c* . . . and 21*a*, 21*b*, 21*c* . . . These are arranged on either side of a central spindle-shaped molding member 22.

The metal sheets 11 and 12, which during manufacture of the chute walls 10 are arranged in pairs between the molding plates 20*a*, 20*b* or 21*a*, 21*b*, are detachably fixed to the facing sides of the abovementioned molding plates. In the present embodiment all molding plates 20*a* . . . 21*a* . . . are, for this purpose, provided on the sides facing the metal sheets 11 and 12 with magnets 23 set in recesses. The outer faces of the magents are flush with the surfaces of the molding plates 20*a*, 21*a*. Such magnets 23 are located in the wedge-shaped zone 10*a* of the chute walls 10. In the arc-shaped zone 10*b*, the metal sheets 11, 12 are pressed directly against one another by the molding plates.

The molding plates 20*a*, 20*b* . . . and 21*a*, 21*b* . . . , which differ in length and geometrical shape, are detachably fixed by holders in a relative position corresponding to the shape of the chute walls 10 which are to be produced. These holders consist of a V-shaped support plate 24 and an opposite counter-plate 25. The individual molding plates 20*a* . . . and 21*a* . . . abut substantially perpendicularly against the two arms of the support plate 24.

The ends which face one another at the arc-shaped zone 10*b* are detachably fixed by their end faces to the support plate 24. Two holding screws 26 arranged one above the other pass through the support plate 24 into the end of a molding plate 20*a* or 21*a*. The bores 26 are so arranged, in the longitudinal direction of the support plate 24, that the relative position of the molding plates, including the metal sheets 11, 12 accommodated between them, is predetermined within this zone.

The planar counter-plate 25 located on the opposite side is placed against the molding plates after the packet of molding plates and metal sheets 11, 12 has been formed, in such a way that the centering pins 27 of the counter-plate 25 fit into corresponding recesses 28 in the molding plates. On the underside, the cavity formed by the metal sheets 11, 12 between the molding plates is defined by a continuous base plate 29, on which the support plate 24 and the counter-plate 25 rest.

In producing the chute walls 10 of varying shapes, the procedure followed is to build up the packet successively starting from the central molding member 22. Accordingly, the first molding plate 20*a* or 21*a* is first placed against the molding member 22 and fixed loosely by means of the holding screws 26. The first metal sheet 12 is then placed against the molding wall 20*a* or 21*a* and is provided with the adhesive 13 in the arc-shaped zone 10*b*. The second metal sheet 11 is then applied, followed by the corresponding molding wall 20*b*. Further pairs of metal sheets 11, 12 can now be placed in position, in each case with a molding plate, until a certain partial packet is formed. Pressure is now exerted on this partial packet, for example on the molding plate 20*d*, by means of a clamping device 30. The latter is movably mounted on an arm of the support plate 24 and can be fixed in the particular desired position by means of a knurled screw 31. The clamping device 30 comprises a clamping jaw 32, which rests against the particular outer molding plate 20*d* in the arc-shaped zone 10*b*. Accordingly, the molding plates and metal sheets 11, 12 are here pressed against one another, the direction of the force being such that it generates a component in the direction towards the support plate 24, so that the molding plates and metal sheets 11, 12 are pressed against this support plate 24. The clamping jaw 32 is pivotably mounted on a threaded bolt 33 which is axially adjustable by means of a setting screw 34 to thereby generate the required contact pressure. The retracted end position of this clamping device 30 is shown in broken lines in FIG. 7. The clamping device 30 travels in a slot 35 of the support plate 24, and is clamped in the desired position by means of the knurled screw 31.

After the packet corresponding to the number of chute walls for a cigarette magazine has been built up, the counter-plate 25 is applied in the described manner to the free side, and is fixed at the sides by screws 36. At the same time, the holding screws 26 for all the molding plates 20*a*, 20*b* . . . and 21*a*, 21*b* . . . are tightened. The filler which forms the spacers 14 can now be introduced into the wedge-shaped cavities in the manner described above.

The base plate 29 is provided with threaded pins 37 for temporarily accommodating the threaded bushes 17, 18 which are to be embedded in the filler. These bushes are screwed onto the threaded pins 37 which pass through the base plate 29 from below. After the filler has hardened the threaded pins 37 are unscrewed from the bushes 17, 18 which are now firmly held in the spacer 14.

What is claimed is:

1. A mold apparatus for manufacturing chute wall partitions (10) for forming chambers within a cigarette magazine hopper, each partition comprising a pair of outer metal sheets (11, 12) disposed in an elongated V configuration and bonded (13) together at their converging ends, and a hardened spacer composition (14) filling the remaining wedge-shaped volume between the diverging, facing inner surfaces of the sheets, said apparatus comprising:

(a) a holding jig including a planar base plate (29), a support plate (24) secured to and upstanding from said base plate, and a counter plate (25) secured to and upstanding from said base plate and spaced from said support plate, (b) a plurality of pattern plates (20, 21) each having a pair of opposite faces, and each face being differently configured to correspond to an outer shape of a chute wall partition to be formed thereby, (c) means for individually releasably mounting each of said pattern plates at opposite ends thereof to and between said support plate and counter plate and against said base plate in at least one diverging group such that a plurality of wedge-shaped spaces are defined between adjacent ones of said pattern plates each corresponding to the overall shape of a desired chute wall partition, and (d) means for individually temporarily securing the outer metal sheets to the faces of said pattern plates, whereby softened spacer composition and bonding material may be appropriately introduced between respective pairs of metal sheets to thereby form said chute wall partitions.

2. An apparatus in accordance with claim 1, wherein the pattern plates are arc-shaped at their ends corresponding to the converging ends of the metal sheets.

3. An apparatus in accordance with claim 1 or 2, wherein the temporary securing means comprise magnets (23) mounted in the faces of the pattern plates.

4. An apparatus in accordance with claim 3, wherein the pattern plates are combined into two complementary groups in positions relative to one another that correspond to the shapes of the chute wall partitions of a complete cigarette magazine hopper.

5. An apparatus in accordance with claim 3, further comprising a tensioning device (30) mounted on the holding jig for applying clamping pressure to a mounted stack of pattern plates and outer metal sheets in the vicinity of the converging ends of the sheets.

6. An apparatus in accordance with claim 5, wherein the releasable mounting means comprises screw and post means (26, 27).

7. An apparatus in accordance with claim 6, wherein one of said mounting plates has a V shape with the apex thereof facing the other mounting plate, whereby a plurality of chute wall partitions of different lengths and configurations may be formed.

* * * * *